US005480143A

United States Patent [19]

McMurry

[11] Patent Number: 5,480,143

[45] Date of Patent: Jan. 2, 1996

[54] WINGED PRACTICE BALL

[76] Inventor: Gary D. McMurry, 427 Shearer Blvd., Cocoa, Fla. 32922

[21] Appl. No.: 219,546

[22] Filed: Mar. 28, 1994

[51] Int. Cl.[6] ..... A63B 43/00

[52] U.S. Cl. ..... 273/58 R; 273/58 D; 273/58 K; 273/65 EE; 273/65 EG

[58] Field of Search ..... 273/58 R, 58 D, 273/58 E, 58 K, 58 A, 58 B, 58 AB, 428, 65 R, 65 EG, 65 EE

[56] References Cited

U.S. PATENT DOCUMENTS

| | | | |
|---|---|---|---|
| 2,521,703 | 9/1950 | Emmitt | 273/58 K |
| 2,783,046 | 2/1957 | Lien | 273/58 R |
| 3,106,397 | 10/1963 | Lacey | 273/58 B |
| 3,147,979 | 9/1964 | Wolfe | 273/199 |
| 4,149,723 | 4/1979 | Simon | 273/58 K X |
| 4,177,995 | 12/1979 | Surland | 273/199 |
| 4,577,867 | 3/1986 | Lenhart | 273/58 R X |
| 5,133,550 | 7/1992 | Handy | 273/58 K X |
| 5,207,420 | 5/1993 | Crawford et al. | 273/58 K X |

*Primary Examiner*—William H. Grieb
*Attorney, Agent, or Firm*—Paul S. Rooy

[57] ABSTRACT

A practice ball comprised of mutually perpendicular X-, Y- and Z-members. A plurality of wings interconnect the X-, Y- and Z- members. The shape of said wings skeletally defines the shape of the practice ball. The wings and reduced weight of the practice ball provide for a shorter trajectory for the practice ball than the equivalent standard ball (golf, tennis, etc.), thereby allowing smaller playing fields to be used. The practice ball may be manufactured by means of an injection molding process, and produces a pleasant whirring sound in flight.

10 Claims, 6 Drawing Sheets

FIG 1
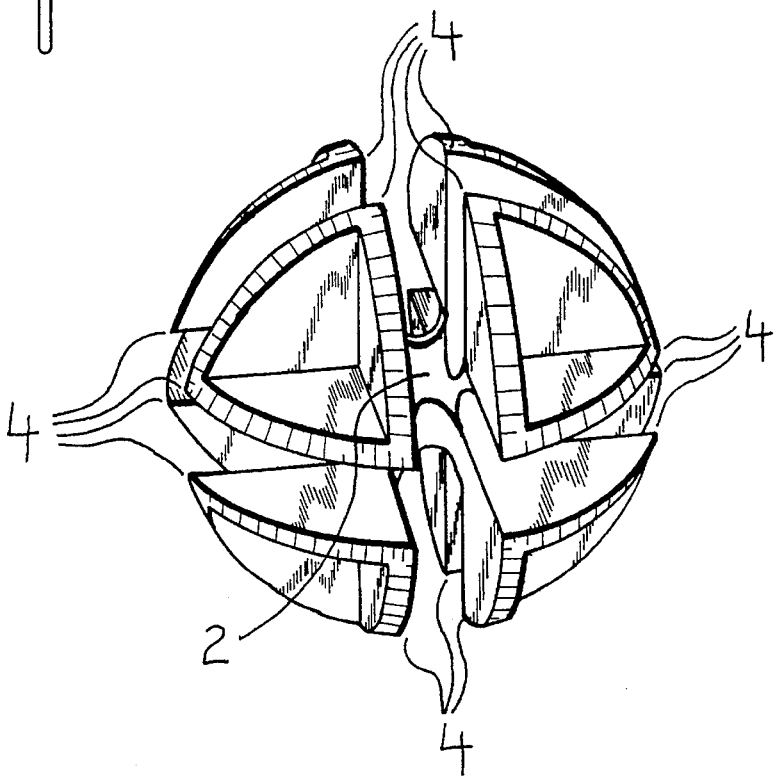
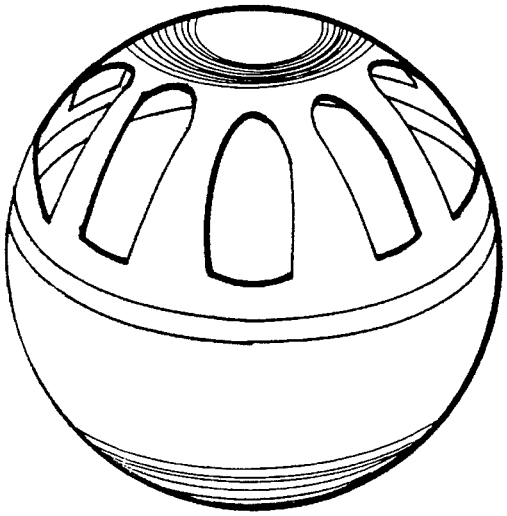
FIG 2

FIG 5
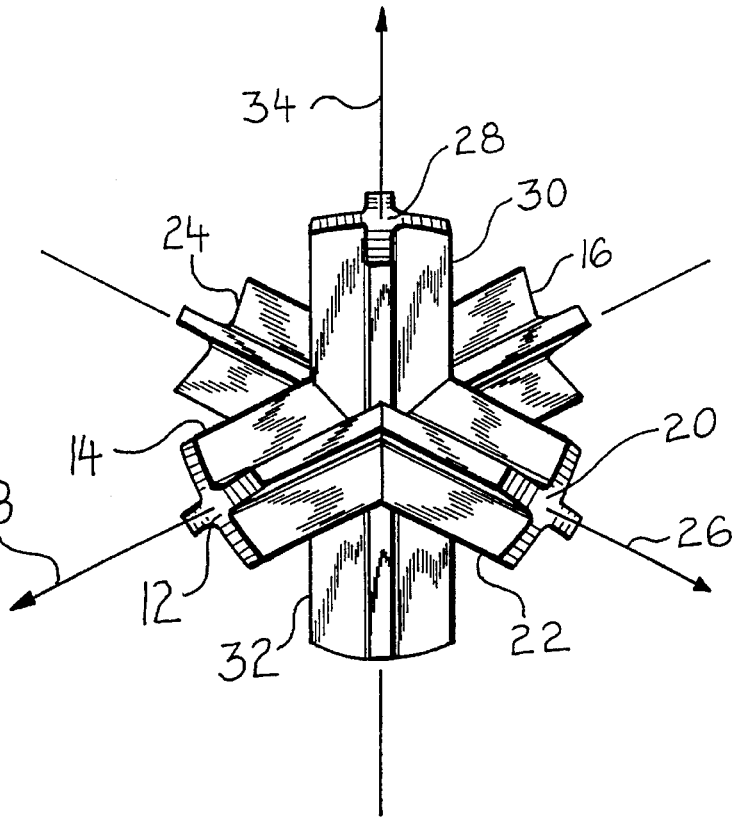
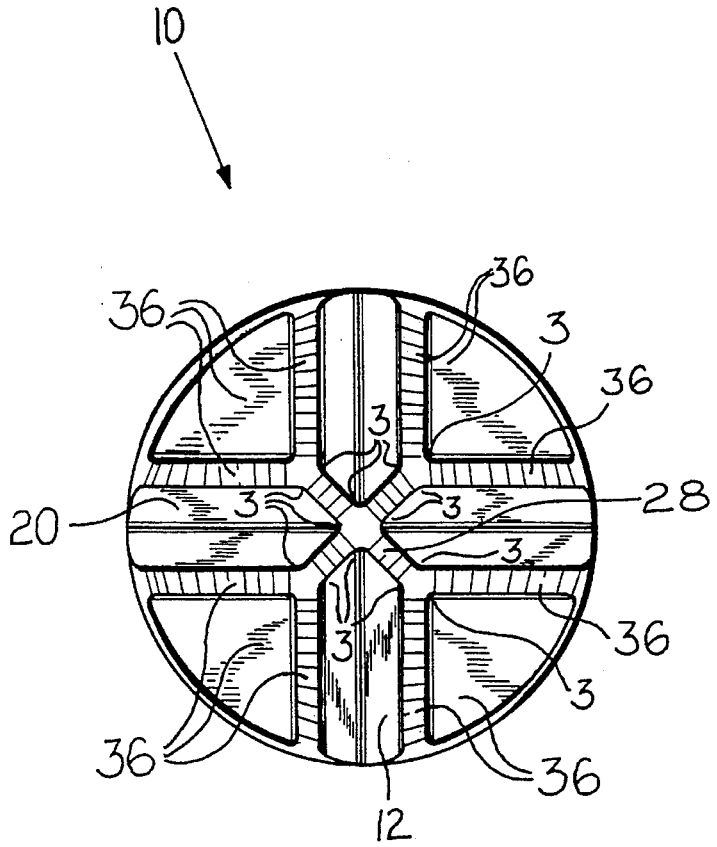
FIG 6

WINGED PRACTICE BALL

BACKGROUND OF THE INVENTION

1. Field of the Invention

This invention relates to game balls, and in particular to a practice game ball.

2. Background of the Invention

As a consequence of the growing world population and the resultant increased scarcity of land, it is becoming difficult to find space to play or practice sports. Playing space may be particularly hard to find for ball sports such as baseball, softball, golf, cricket, tennis, etc., which require large playing areas.

Golf, for example, has developed into a popular sports activity around the world. The game can be costly, however. An average 18 hole course may extend several thousand yards and occupy 120 acres of ground. Even practice with conventional golf balls requires a large area; retrieving the balls is time-consuming, and it may be difficult to find the balls. Given the high price of real estate in many locations, this cost can increase the expense of play significantly.

In addition, golf courses tend to be located out in the country, in areas removed from centers of population. Consequently, a lengthy trip may be required to get to the course and back home.

One approach toward solving these problems involves the use of short range golf balls. These balls are designed to simulate the feel of a conventional golf ball when struck with a standard golf club, yet travel significantly less distance. Used on a conventional golf course, short range balls may allow twice (or more) as many strokes per hole, thereby greatly increasing the amount of practice enjoyed by the player. Also, the reduced travel of these short range golf balls may be sufficiently short to allow the golfer to practice shots in his own back yard. In this manner the cost of playing or practicing is greatly reduced, and travel time and travel cost is eliminated.

The short range ball solution may also be used in other ball sports which require large playing areas. For example, baseball, softball, golf, cricket, and tennis may all be played with an appropriately sized short range ball, as may badminton. In this fashion the difficulty of finding playing space is greatly reduced, and travel time and travel expense may be decreased or eliminated. In addition, the convenience of play is greatly enhanced, which may result in more frequent play with attendant increase in exercise by the participants.

Existing Designs

Numerous approaches have been taken toward designing short range balls. One approach consists of manufacturing the ball as a one piece plastic fabrication. A one piece short range ball could be made using an injection molding process.

An example of a one piece plastic short range ball design is illustrated in FIG. 1. This design suffers from a number of drawbacks. The narrow center section 2 is the weakest point of the ball, and typically breaks before the ball is hit 100 times. In addition, during an injection molding process, the center section remains soft longer than the rest of the ball, due to the its thickness. This limits the speed of the injection molding process because if the process speed is increased, the center section will deform when the ball is ejected from the mold, thereby creating defective balls. Finally, sharp corners 4 present a safety hazard. If a person were to be struck by a sharp corner 4 of a fast traveling ball, the person could be injured by the a sharp corner 4, especially if struck in the eye or some other especially vulnerable spot.

Another one piece plastic short range ball is illustrated in FIG. 2. This design comprises a hollow shell with numerous perforations. Drawbacks associated with this design include unrealistic feel and erratic flight characteristics. Used as a golf ball, in particular, the one piece plastic short range ball illustrated in FIG. 2 does not simulate a conventional golf ball well, especially when struck with a standard golf club, or when in flight.

A number of patents have been granted for practice balls. U.S. Pat. No. 4,177,995 was issued for a golf practice device comprising a drag member attached to a golf ball by means of a o flexible elongated member. This device allows the golfer to hit the ball, and then the drag member slows and shortens the flight of the golf ball. Disadvantages associated with this device include complexity and cost. U.S. Pat. No. 3,147,979 was granted for a parachute attached to a golf ball by means of a plurality of cords. After the ball is struck, the parachute slows and shortens the flight of the ball. One disadvantage associated with this design is a trajectory which is different from that of a conventional golf ball.

U.S. Pat. No. 4,577,867 was issued for a short flight ball comprising an outer shell of reticulated resinous veins and a central core that is smaller and lighter than a regulation golf ball. Disadvantages associated with this design include complexity and cost.

SUMMARY OF THE INVENTION

Accordingly, it is an object of the present invention to provide a practice ball which will realistically simulate the flight of a standard ball while traveling significantly shorter distances. Design features allowing this object to be accomplished include a plurality of wings rigidly attached to the rest of the practice ball. Advantages associated with the accomplishment of this object include reduced difficulty in finding playing space, eliminated travel time and travel cost, and increased convenience of play or practice.

It is another object of the present invention to provide a practice ball which produces a sound when in flight. Design features allowing this object to be accomplished include an X-member, Y-member and Z-member having an "X" shaped cross section, and a plurality of wings interconnecting the X-, Y- and Z- members. A benefit associated with the accomplishment of this object is a pleasant and novel "whirring" sound which adds to the enjoyment of the players.

It is another object of this invention to provide a practice ball which presents a surface which is smooth and rounded to the touch. Design features enabling the accomplishment of this object include smoothly curved wings and a smoothly curved X-member, Y-member and Z-member. An advantage associated with the realization of this object is increased player safety.

It is still another object of this invention to provide a practice ball whose components are approximately the same thickness. Design features allowing this object to be achieved include an X-member, Y-member, Z-member, and wings whose elements are approximately all the same thickness. Benefits associated with reaching this objective include more uniform cooling of injection molded practice balls, an increased production rate, less rejects, and production cost savings.

It is a further object of this invention to provide a practice ball which is strong enough to withstand the rigors of play over an extended life. Features permitting this object to be accomplished include a plurality of wings interconnecting the X-, Y- and Z- members. Benefits associated with the achievement of this object include increased product life and associated consumer cost savings.

BRIEF DESCRIPTION OF THE DRAWINGS

The invention, together with the other objects, features, aspects and advantages thereof will be clearly more understood from the following in conjunction with the accompanying drawings.

Six sheets of drawings are provided. Sheet one contains FIGS. 1 and 2. Sheet two contains FIG. 3. Sheet three contains FIG. 4. Sheet four contains FIGS. 5 and 6. Sheet five contains FIG. 7. Sheet six contains FIG. 8.

FIGS. 1 and 2 are front isometric views of existing one-piece plastic ball designs.

FIG. 5 is a front isometric view of the X-member, Y-member, and Z-member.

FIG. 6 is a top view of a practice ball.

DETAILED DESCRIPTION OF THE PREFERRED EMBODIMENT

Figure 3:
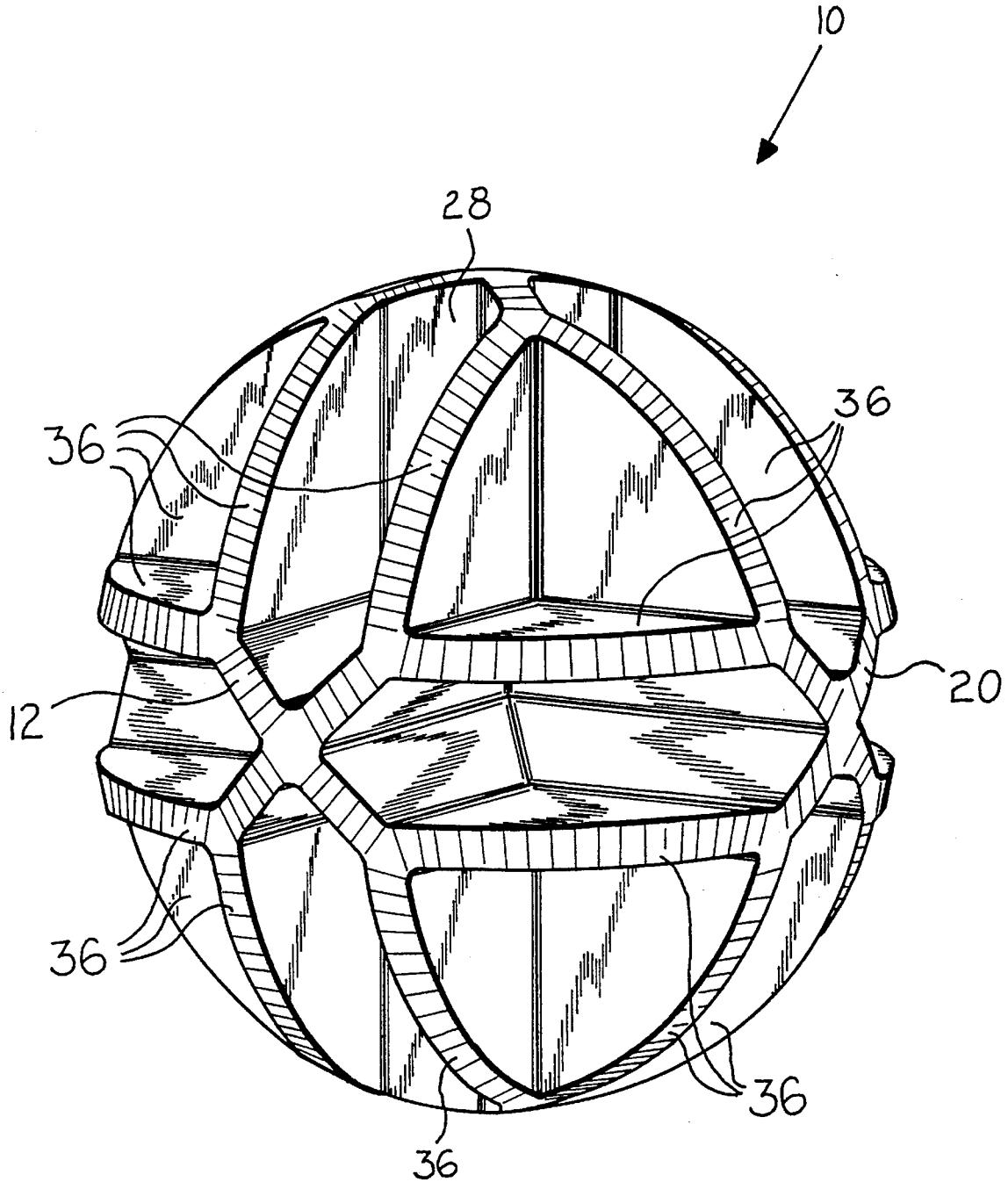
FIG. 3 is a front quarter isometric view of a practice ball.

FIG. 3 is a front quarter isometric view of practice ball 10. Referring also to FIG. 5, practice ball 10 is comprised of X-member 12, Y-member 20, Z-member 28, and wings 36. X-member 12 comprises X-member front leg 14 and X-member rear leg 16. Y-member 20 comprises Y-member right leg 22 and Y-member left leg 24. Z-member 28 comprises Z-member top leg 30 and Z-member bottom leg 32.

The disposition in space of X-member 12, Y-member 20 and Z-member 28 may be defined through reference to a three dimensional Cartesian coordinate system: X-member 12 is disposed along X-axis 18, Y-member 20 along Y-axis 26 and Z-member 28 along Z-axis 34. X-member 12, Y-member 20 and Z-member 28 are rigidly attached at their midpoints. The point at which X-member 12, Y-member 20 and Z-member 28 are attached corresponds to the origin of the three dimensional Cartesian coordinate system.

The origin of the Cartesian coordinate system divides X-member 12, Y-member 20 and Z-member 28 into halves. X-member front leg 14 lies along the positive part of X-axis 18; X-member rear leg 16 lies along the negative part of X-axis 18. Y-member right leg 22 lies along the positive part of Y-axis 26; Y-member left leg 24 lies along the negative part of Y-axis 26. Z-member top leg 30 lies along the positive part of Z-axis 34; Z-member bottom leg 32 lies along the negative part of Z-axis 34.

Figure 4:
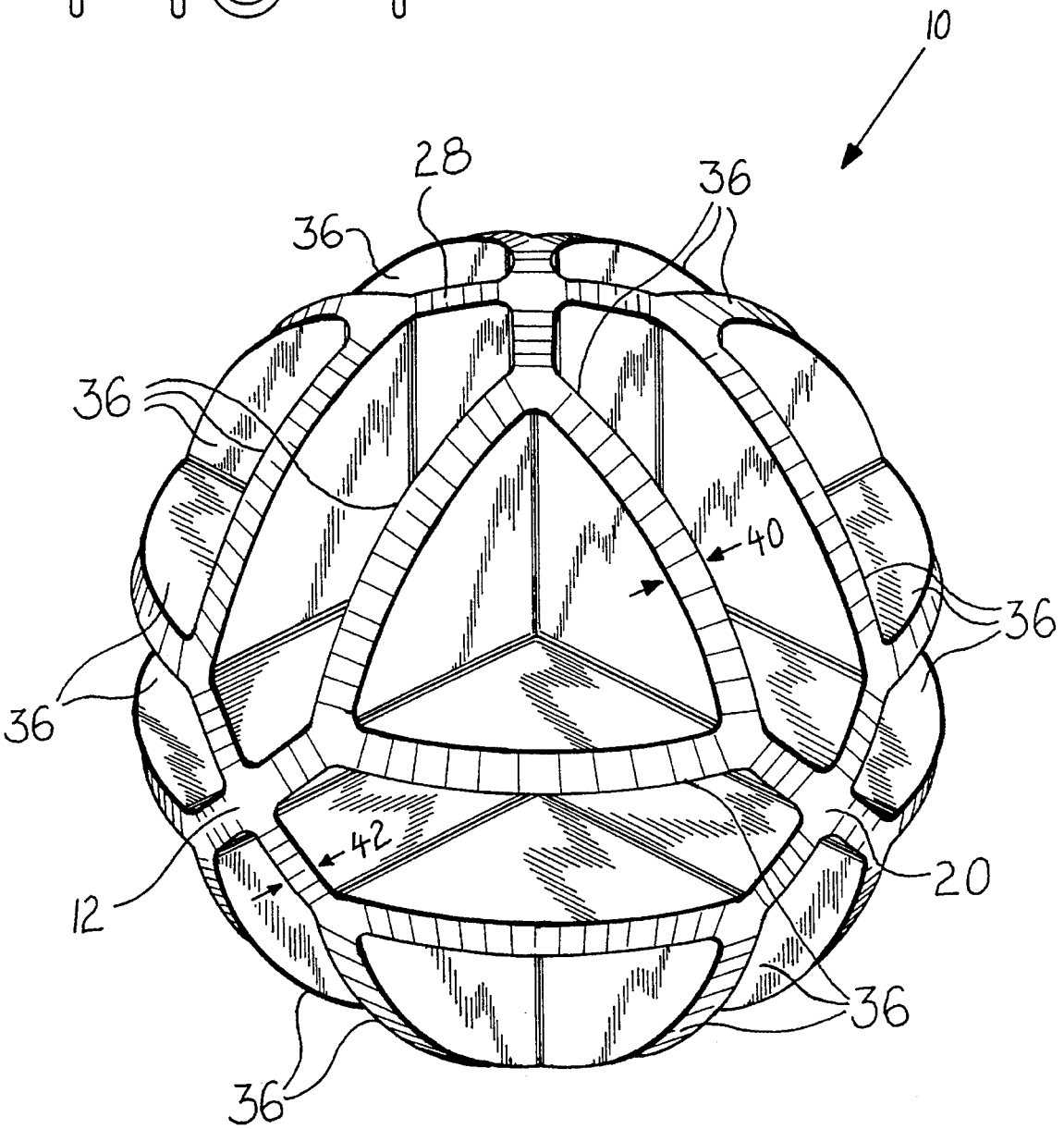
FIG. 4 is a front isometric view of a practice ball.

Wings 36 rigidly interconnect X-member 12, Y-member 20 and Z-member 28. Wings 36 are shaped like flat quarter circles, thereby skeletally defining the shape of practice ball 10 as a sphere. Referring to FIG. 4, lobe thickness 42 is approximately the same as wing thickness 40.

Figure 7:
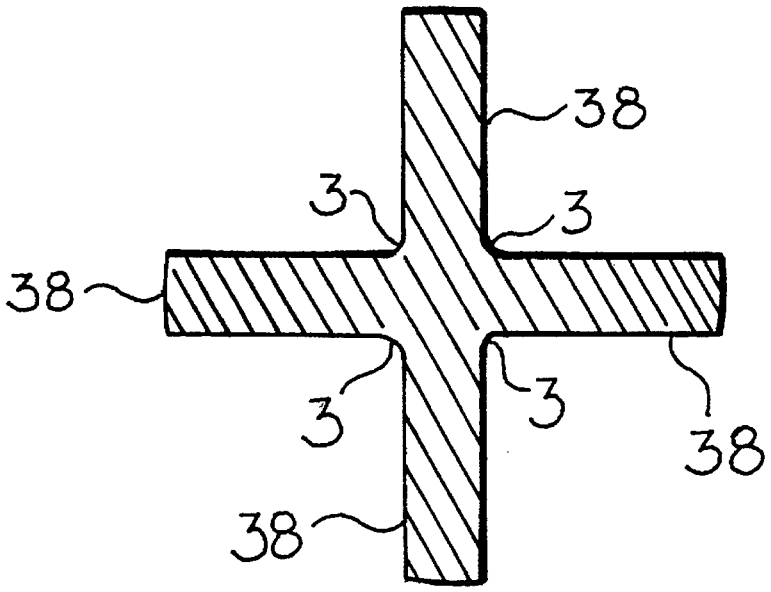
FIG. 7 is a cross-sectional view of an X-, Y- or Z- member.

Referring to FIG. 7, the preferred embodiment cross sectional shape of X-member 12, Y-member 20 and Z-member 28 is that of an "X" having four lobes 38. Wings 36 interconnect:

- two Z-member top leg 30 lobes 38 with two X-member front leg 14 lobes 38,
- two Z-member top leg 30 lobes 38 with two X-member rear leg 16 lobes 38,
- two Z-member top leg 30 lobes 38 with two Y-member left leg 24 lobes 38,
- two Z-member top leg 30 lobes with two Y-member right leg 22 lobes 38,
- two Z-member bottom leg 32 lobes 38 with two X-member front leg 14 lobes 38,
- two Z-member bottom leg 32 lobes 38 with two X-member rear leg 16 lobes 38,
- two Z-member bottom leg 32 lobes 38 with two Y-member left leg 24 lobes 38,
- two Z-member bottom leg 32 lobes 38 with two Y-member right leg 22 lobes 38,
- two X-member front leg 14 lobes 38 with two Y-member left leg 24 lobes 38,
- two Y-member left leg 24 lobes 38 with two X-member rear leg 16 lobes 38,
- two X-member rear leg 16 lobes 38 with two Y-member right leg 22 lobes 38, and
- two Y-member right leg 22 lobes 38 with two X-member front leg 14 lobes 38.

Referring to FIG. 6, fillets 3 are used extensively throughout the design of practice ball 10 to increase the strength of the structure. Fillets 3 are used where lobes 38 are mutually attached, where wings 36 attach to lobes 38 and where two wings 36 mutually attach to a common lobe.

Figure 8:
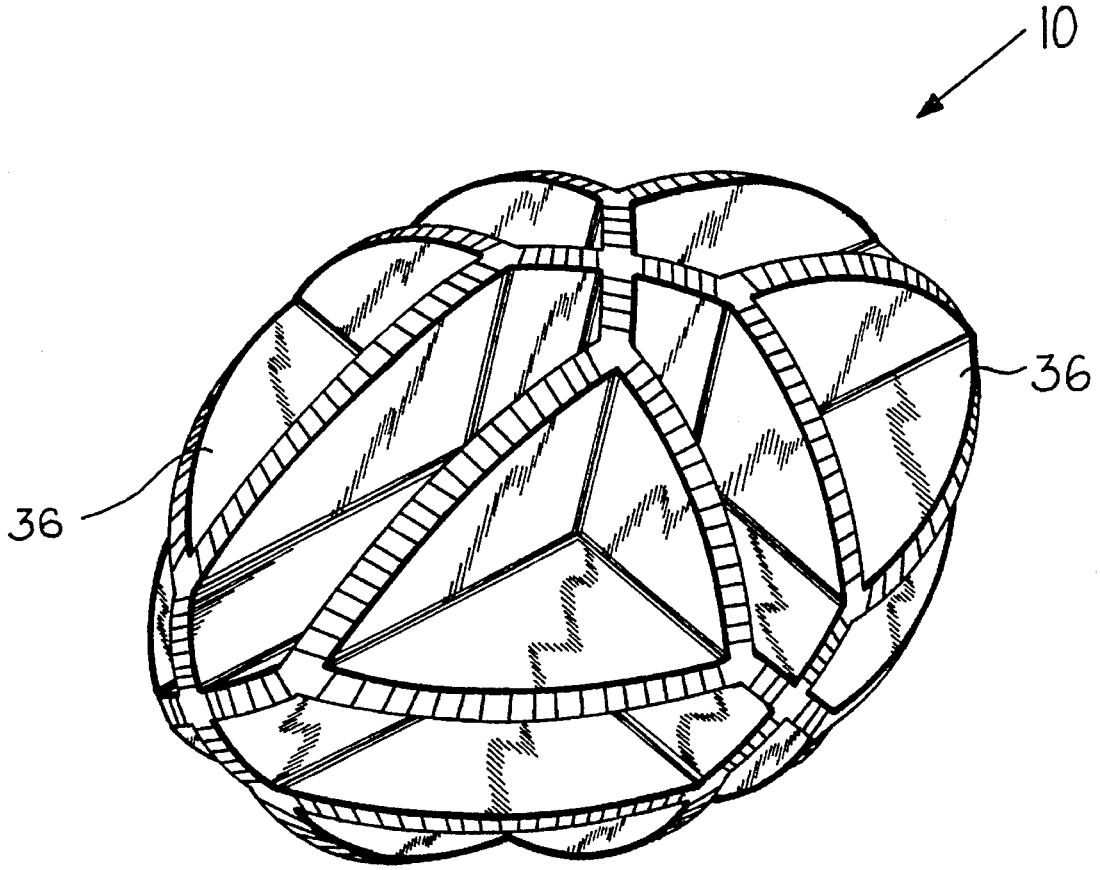
FIG. 8 is a front isometric view of an alternate embodiment of practice ball.

FIG. 8 is a front isometric view of an alternate embodiment of practice ball 10. Wings 36 are shaped like flat quarter ovals, thereby defining the shape of practice bell 10 as an American football.

Practice ball 10 may be manufactured of elastomers (polyurethane, olefinic/rubber, polyamide/rubber, etc.), low density polyethelyne, nylon, or other appropriate material.

Practice ball 10 may range in size from the size of a standard golf ball (or smaller) to that of a softball, or larger. The shape of practice ball 10 may include, but is not limited to, a sphere, football, etc. When traveling through the air, wings 36 produce a pleasant "whirring" sound.

While a preferred embodiment of the invention has been illustrated herein, it is to be understood that changes and variations may be made by those skilled in the art without departing from the spirit of the appending claims.

DRAWING ITEM INDEX

2 center section
3 fillet
4 sharp corner
10 practice ball
12 X-member
14 X-member front leg
16 X-member rear leg
18 X-axis
20 Y-member
22 Y-member right leg
24 Y-member left

26 Y-axis

28 Z-member

30 Z-member top leg

32 Z-member bottom leg

34 Z-axis

36 wing

38 lobe

40 wing thickness

42 lobe thickness

I claim:

1. A practice ball comprising an X-member, a Y-member and a Z-member rigidly attached at their midpoints, and a plurality of wings interconnecting said X-member, Y-member and Z-member, said wings being shaped like flat webs, said X-member, Y-member and Z-member having a constant cross-section over their lengths through a point at which said X-member, Y-member and Z-member are mutually attached.

2. The practice ball of claim 1 wherein said X-member, said Y-member and said Z-member are aligned with an X-axis, Y-axis and Z-axis of a three dimensional Cartesian coordinate system whose origin is located at the point where said X-member, said Y-member and said Z-member are attached to each other, the origin of said Cartesian coordinate system dividing said X-member, said Y-member and said Z-member into halves, an X-member front leg lying along the positive part of said X-axis, an X-member rear leg lying along the negative part of said X-axis, a Y-member right leg lying along the positive part of said Y-axis, a Y-member left leg lying along the negative part of said Y-axis, a Z-member top leg lying along the positive part of said Z-axis, and a Z-member bottom leg lying along the negative part of said Z-axis.

3. The practice ball of claim 2, wherein said wings are shaped like flat quarter ovals, whereby the shape of said practice ball is skeletally defined by said wings as an American football.

4. The practice ball of claim 1 wherein said wings are shaped like flat quarter ovals, whereby the shape of said practice ball is skeletally defined by said wings as an American football.

5. A practice ball comprising an X-member, a Y-member and a Z-member rigidly attached at their midpoints, and a plurality of wings interconnecting said X-member, Y-member and Z-member, said X-member, Y-member and Z-member having a constant cross-section over their lengths through a point at which said X-member, Y-member and Z-member are mutually attached, said X-member, Y-member, Z-member and said wings comprising a single contiguous piece.

6. A practice ball comprising an X-member, a Y-member and a Z-member rigidly attached at their midpoints, and a plurality of wings interconnecting said X-member, Y-member and Z-member;

said X-member, said Y-member and said Z-member being aligned with an X-axis, Y-axis and Z-axis of a three dimensional Cartesian coordinate system whose origin is located at the point where said X-member, said Y-member and said Z-member are attached to each other, the origin of said Cartesian coordinate system dividing said X-member, said Y-member and said Z-member into halves;

an X-member front leg lying along the positive part of said X-axis, an X-member rear leg lying along the negative part of said X-axis, a Y-member right leg lying along the positive part of said Y-axis, a Y-member left leg lying along the negative part of said Y-axis, a Z-member top leg lying along the positive part of said Z-axis, and a Z-member bottom leg lying along the negative part of said Z-axis;

said wings being shaped like flat quarter circles, whereby the shape of said practice ball is skeletally defined by said wings as a sphere.

7. A practice ball comprising an X-member, a Y-member and a Z-member rigidly attached at their midpoints, and a plurality of wings interconnecting said X-member, Y-member and Z-member;

said X-member, said Y-member and said Z-member being aligned with an X-axis, Y-axis and Z-axis of a three dimensional Cartesian coordinate system whose origin is located at the point where said X-member, said Y-member and said Z-member are attached to each other, the origin of said Cartesian coordinate system dividing said X-member, said Y-member and said Z-member into halves; said X-member, said Y-member and said Z-member having a cross-sectional shape of an "X" comprising four lobes;

an X-member front leg lying along the positive part of said X-axis, an X-member rear leg lying along the negative part of said X-axis, a Y-member right leg lying along the positive part of said Y-axis, a Y-member left leg lying along the negative part of said Y-axis, a Z-member top leg lying along the positive part of said Z-axis, and a Z-member bottom leg lying along the negative part of said Z-axis.

8. The practice ball of claim 7 wherein the thickness of said wings is approximately equal to the thickness of said lobes.

9. The practice ball of claim 7 wherein said wings interconnect:

two Z-member top leg lobes with two X-member front leg lobes;

two Z-member top leg lobes with two X-member rear leg lobes;

two Z-member top leg lobes with two Y-member left leg lobes;

two Z-member top leg lobes with two Y-member right leg lobes;

two Z-member bottom leg lobes with two X-member front leg lobes;

two Z-member bottom leg lobes with two X-member rear leg lobes;

two Z-member bottom leg lobes with two Y-member left leg lobes;

two Z-member bottom leg lobes with two Y-member right leg lobes, two X-member front leg lobes with two Y-member left leg lobes;

two Y-member left leg lobes with two X-member rear leg lobes;

two X-member rear leg lobes with two Y-member right leg lobes; and two Y-member right leg lobes with two X-member front leg lobes.

10. The practice ball of claim 9 further comprising fillets disposed where said lobes are mutually attached, where said wings attach to said lobes and where two said wings mutually attach to a common said lobe, whereby the strength of said practice ball is increased.

* * * * *